US006474255B2

(12) United States Patent
Geriene et al.

(10) Patent No.: US 6,474,255 B2
(45) **Date of Patent: *Nov. 5, 2002**

(54) ARCUATE-WINGED SUBMERSIBLE VEHICLES

(75) Inventors: Marc Geriene; Krist Geriene, both of Kenmore, WA (US)

(73) Assignee: Nova Marine Exploration, Inc., Kirkland, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/898,777

(22) Filed: Jul. 3, 2001

(65) Prior Publication Data

US 2001/0045183 A1 Nov. 29, 2001

Related U.S. Application Data

(63) Continuation of application No. 09/357,537, filed on Jul. 19, 1999, now Pat. No. 6,276,294.

(51) Int. Cl.[7] ..... B63G 8/00
(52) U.S. Cl. ..... 114/312; 114/245
(58) Field of Search ..... 114/312, 313, 114/322, 331, 337, 338, 244, 245, 246, 253

(56) References Cited

U.S. PATENT DOCUMENTS

| | | | |
|---|---|---|---|
| 2,081,868 A | 5/1937 | Hampden | 114/274 |
| 2,377,442 A | 6/1945 | Osterhoudt | 114/245 |
| 3,137,264 A | 6/1964 | Brainard, II et al. | 114/244 |
| 3,183,871 A | 5/1965 | Reder | 114/281 |
| 3,703,876 A | 11/1972 | Michelsen | 114/235 B |
| 3,805,730 A | 4/1974 | Henderson et al. | 114/235 B |
| 4,007,505 A | 2/1977 | Nowatzki | 9/8 R |
| 4,030,434 A | 6/1977 | Pedlar et al. | 114/16 R |
| 4,055,138 A | 10/1977 | Klein | 114/244 |

(List continued on next page.)

FOREIGN PATENT DOCUMENTS

| | | |
|---|---|---|
| JP | 1-240398 A | 9/1989 |
| WO | WO 90/11927 | 10/1990 |

OTHER PUBLICATIONS

Batfish II, *Remotely Operated Vehicles of the World*, (96/97 Edition), p. 174.

Marlin, *Remotely Operated Vehicles of the World*, (96/97 Edition), p. 196.

*Primary Examiner*—Ed Swinehart
(74) *Attorney, Agent, or Firm*—Dorsey & Whitney LLP

(57) ABSTRACT

Arcuate-winged submersible vehicles having improved hydrodynamic stability and maneuverability for use in, for example, underwater payload delivery and data acquisition. In one embodiment, a submersible vehicle includes a body having a pair of outwardly projecting at least partially arcuate wings, an adjustably positionable wing steering flap hingeably attached to each wing, at least one wing flap actuator coupled to the hull and to the wing steering flaps to controllably adjust the position of the wing steering flaps, an adjustably positionable hingeable tail steering flap attached to the hull, and at least one tail flap actuator coupled to the hull and to the tail steering flap to controllably adjust the position of the tail steering flap. The arcuate wings provide improved stability and maneuverability characteristics of the vehicle. In alternate embodiments, a vehicle may include arcuate wings having a swept leading edge or a swept trailing edge, or both. In another embodiment, a vehicle has a tow assembly attached to the hull and coupleable with a tow cable for towing the vehicle behind a surface vessel or for launching and recovery of the vehicle. In yet another embodiment, a vehicle includes a propulsion unit attached to the hull for propelling the vehicle through a fluid medium. Alternately, a vehicle has a control unit operatively coupled to at least one actuator, the control unit providing a control signal to actuate the actuator to adjust a position of at least one of the wing steering flaps or the tail steering flap.

25 Claims, 5 Drawing Sheets

U.S. PATENT DOCUMENTS

| | | | | |
|---|---|---|---|---|
| 4,350,111 | A | 9/1982 | Boyce, II | 114/245 |
| 4,395,965 | A | 8/1983 | Lang | 114/20 R |
| D291,299 | S | 8/1987 | Hawkes | D12/308 |
| 4,721,055 | A | 1/1988 | Pado | 114/331 |
| 4,821,665 | A | 4/1989 | Matthias et al. | 114/222 |
| D304,923 | S | 12/1989 | Pado | D12/308 |
| D306,425 | S | 3/1990 | Walker et al. | D12/308 |
| 4,947,782 | A | 8/1990 | Takahashi | 114/312 |
| 5,121,702 | A | 6/1992 | Johnson et al. | 114/330 |
| 5,235,930 | A | 8/1993 | Pendleton | 114/312 |
| 5,552,983 | A | 9/1996 | Thornberg et al. | 364/424.01 |
| 5,615,632 | A | 4/1997 | Nedderman, Jr. | 114/330 |
| 5,708,232 | A | 1/1998 | Nedderman, Jr. | 114/23 |
| 6,276,294 | B1 * | 8/2001 | Geriene et al. | 114/312 |

* cited by examiner

ARCUATE-WINGED SUBMERSIBLE VEHICLES

CROSS REFERENCE TO RELATED APPLICATION

This application is a continuation of U.S. patent application Ser. No. 09/357,537, filed Jul. 19, 1999, now U.S. Pat. No. 6,276,294.

TECHNICAL FIELD

The present invention relates to arcuate-winged submersible vehicles for use in, for example, underwater payload delivery and data acquisition, including hydrographic surveys for commercial, ecological, professional, or recreational purposes.

BACKGROUND OF THE INVENTION

Submersible vehicles are presently used for a wide variety of underwater operations, including inspection of telephone lines and pipe lines, exploration for natural resources, performance of bio-mass surveys of marine life, inspection of hulls of surface vessels or other underwater structures, and to search for shipwrecks and sunken relics. Submersible vehicles may be manned or unmanned, and may carry a wide variety of payloads. Furthermore, submersible vehicles may be towed by a surface vessel, or may be equipped with a propulsion unit for autonomous mobility. Overall, submersible vehicles are an important tool in the performance of a wide variety of hydrographic surveys for commercial, ecological, professional, or recreational purposes.

FIG. 1 shows a towed submersible vehicle 10 and related support equipment in accordance with the prior art. In this embodiment, the submersible vehicle 10 includes a hull 12 having a streamlined cylindrical body 13. Several fins 14 project radially from the hull 12 as fixed control surfaces. The front (or bow) of the body 13 includes an open aperture 16 covered by a transparent window 18. The body 13 has a substantially enclosed back (or stern) 20 and a tail section 22 which is attached to the back 20 and which has a vertical steering flap 24 and a horizontal steering flap 26. The vertical and horizontal steering flaps 24, 26 are actuated by a pair of actuators (not shown) which are disposed within a payload area 21 inside the body 13. Actuator arms 28 extend through the back 20 of the hull 12 to actuate the vertical and horizontal steering flaps 24, 26.

The hull 12 also includes a tow point 30 located on an upper portion of the body 13 for attaching the submersible vehicle 10 to a tether or tow cable of a surface vessel. A pair of runners 32 are attached to the lower fins 14 to protect the vehicle from striking rocks or other objects on the ocean floor.

Support equipment for the submersible vehicle 10 includes a control unit 34, which is connected to the submersible vehicle 10 by an umbilical 36. Power is delivered to the submersible vehicle 10 through the umbilical 36, and control signals from the controller 34 are transmitted through the umbilical 36 to the actuators for independently actuating the vertical steering flap 24 and the horizontal steering flap 26. In the embodiment shown in FIG. 1, a viewing visor 38 may be connected by the umbilical 36 to a camera located within the payload compartment 21 which transmits photographic images of the underwater scene to the viewing visor 38. A camera control box 40 is electronically coupled to the camera by the umbilical 36, enabling an operator on the surface vessel to adjust the photographic images as desired.

In operation, the submersible vehicle 10 is towed behind a surface vessel over an area of interest, such as a pipeline, potential fishing area, or potential shipwreck area. Wearing the viewing visor 38, the operator uses the controller 34 to control the movement of the submersible vehicle by adjusting the deflections of the vertical and horizontal steering flaps 24, 26. Lateral movement of the submersible vehicle 10 is controlled by deflecting the vertical steering flap 24, causing the vehicle to turn to the right or left (i.e. "yaw"). The depth of the submersible vehicle 10 is controlled by deflecting the horizontal steering flap 26, causing the bow of the vehicle to pitch up or down (i.e. "pitch"). In this way, the operator is able to control the flight of the submersible vehicle 10 over the areas of interest on the ocean floor to perform inspections or acquire desired information.

Although desirable results have been achieved using the prior art system, several characteristics of the submersible vehicle 10 leave room for improvement. For instance, when the vehicle 10 is being towed in a current, especially a current that flows across the direction of travel of the surface vessel, the submersible vehicle 10 may become unstable. Cross-currents tend to cause the submersible vehicle 10 to "roll" about a lengthwise axis so that the runners 32 may no longer remain below the vehicle for protection. The rolling of the submersible vehicle 10 may also interfere with or disable the data acquisition equipment contained within the payload section. Strong currents along the direction of travel of the surface vessel (i.e. along the freestream flow direction) may also hamper the controllability of the vehicle 10.

Also, undesirable rolling characteristics are experienced when the submersible vehicle 10 is guided by the operator to a position that is laterally displaced to the sides of the surface vessel. That is, when the submersible vehicle 10 is flown out widely to the left or to the right of the surface vessel, the tether which is attached to the tow point 30 pulls on the tow point causing the vehicle to roll undesirably.

Furthermore, under some operating conditions, the shape and orientation of the fins 14 and the vertical and horizontal steering flaps 24, 26 fail to provide the desired hydrodynamic stability and controllability of the submersible vehicle 10. In rough seas and high currents, such as those which may be experienced in the fisheries of the North Atlantic and North Pacific Oceans, and in some areas commonly associated with shipwrecks in the southeastern Pacific Ocean, prior art submersible vehicles sometimes fail to provide adequate or required stability or maneuverability characteristics, including roll, pitch, and yaw control.

SUMMARY OF THE INVENTION

The present invention relates to arcuate-winged submersible vehicles with improved stability and maneuverability characteristics. In one embodiment, a vehicle includes a body having a pair of outwardly projecting at least partially arcuate wings, an adjustably positionable wing steering flap hingeably attached to each wing to provide at least partial control of the movement of the vehicle, at least one wing flap actuator coupled to the hull and to the wing steering flaps to controllably adjust the position of the wing flaps, a tail attached to the hull having an adjustably positionable hingeable tail steering flap to provide at least partial control of the movement of the vehicle, and at least one tail flap actuator coupled to the hull and to the tail steering flap to controllably adjust the position of the tail steering flap. The arcuate wings provide improved stability and maneuverability characteristics of the vehicle.

In alternate embodiments, a vehicle may include arcuate wings having a swept leading edge or a swept trailing edge, or both. Alternately, a vehicle may have arcuate wings each having a trailing edge with a substantially planar and a cutout area disposed therein, the wing steering flaps being attached to the arcuate wings and received within the cutout areas. In another embodiment, each arcuate wing has a rearwardly swept leading edge and a forwardly swept trailing edge that joins with the leading edge at a wing tip, and a ratio of a wingspan over a maximum distance from the leading edge to the trailing edge is approximately 3/2. In a further embodiment, each arcuate wing has a wing tip and a wing root attached to the hull, and the curvature of each arcuate wing is such that the wing tip is at approximately the same water line as the wing root.

In yet another embodiment, a vehicle has a tow assembly attached to the hull and coupleable with a tow cable for towing the vehicle behind a surface vessel or for launching and recovery of the vehicle. Alternately, the tow assembly may have an outwardly projecting tow plate hingeably attached to the hull and approximately aligned with a longitudinal axis of the hull, with the tow plate having an at least partially arcuate slot sized to receive and slideably guide a towing device disposed therein.

In still another embodiment, a vehicle includes a propulsion unit attached to the hull for propelling the vehicle through a fluid medium. In an alternate embodiment, a vehicle has a control unit operatively coupled to at least one actuator, the control unit providing a control signal to actuate the actuator to adjust a position of at least one of the wing flaps or the tail flap. Alternately, a vehicle may further include a programmable device operatively coupled to a navigational sensor and at least one actuator, the programmable device receiving an input signal from the navigational sensor and being capable of providing a control signal to the actuator according to the input signal.

In another alternate embodiment, a vehicle includes a hull having a pair of outwardly projecting at least partially arcuate wings, a first control surface attached to the hull that is adjustably positionable to provide at least partial control of at least a first dynamic characteristic of the vehicle, a first actuator coupled to the hull and to the first control surface to controllably adjust the position of the first control surface, a second control surface attached to the hull that is adjustably positionable to provide at least partial control of at least a second dynamic characteristic of the vehicle, and a second actuator coupled to the hull and to the second control surface to controllably adjust the position of the second control surface.

In still another embodiment, a vehicle includes a hull having a pair of outwardly projecting at least partially arcuate wings, adjustable control surface means attached to the hull for adjustably controlling a dynamic characteristic of the vehicle, and a plurality of actuators coupled to the hull and to the adjustable control surface means to controllably adjust the adjustable control surface means.

DETAILED DESCRIPTION OF THE INVENTION

The present invention relates to arcuate-winged submersible vehicles for use in, for example, underwater payload delivery and data acquisition, including hydrographic surveys for commercial, ecological, professional, or recreational purposes. Many specific details of certain embodiments of the invention are set forth in the following description and in FIGS. 2–8 to provide a thorough understanding of such embodiments. One skilled in the art, however, will understand that the present invention may have additional embodiments, or that the present invention may be practiced without several of the details described in the following description.

Figure 2:
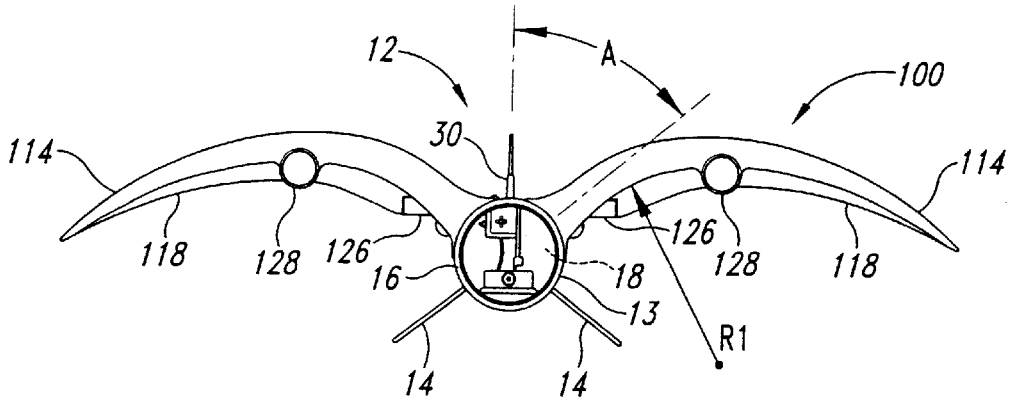
FIG. 2 is a front elevational view of an arcuate-winged submersible vehicle in accordance with an embodiment of the invention.

FIG. 2 shows a front elevational view of an arcuate-winged submersible vehicle 100 in accordance with the present invention. In this embodiment, the vehicle 100 has a hull 12 that includes a cylindrical body 13 and a pair of arcuate (or "gull-shaped") wings 114 projecting outwardly from the body 13 at an angle A with the vertical (see FIG. 2). The arcuate wings 114 may typically attach to the body over a range of angles from about 30 to about 70 degrees, with a value of A of approximately 50 degrees being preferred. Each arcuate wing 114 has a partially curved or arcuate shape with a lateral radius of curvature R1 that varies from the wing root 122 to the wing tip 120. In this embodiment, the lateral radius of curvature R1 of the arcuate wings 114 increases with increasing distance from the body 13 and is greater near the leading edges 116 or bow of the vehicle 100 and less along the trailing edges 118 of the wings. A pair of straight planar fins 14 project downwardly and radially outward from the body 13. The body 13 has an aperture 16 at the bow covered by a transparent window 18 (see FIG. 3), a watertight, enclosed back 20, and an interior payload compartment 21. The hull 12 also has a tow point 30 attached along a top portion of the body 13. A light fixture 128 is attached to a lower surface of each wing 114.

Figure 3:
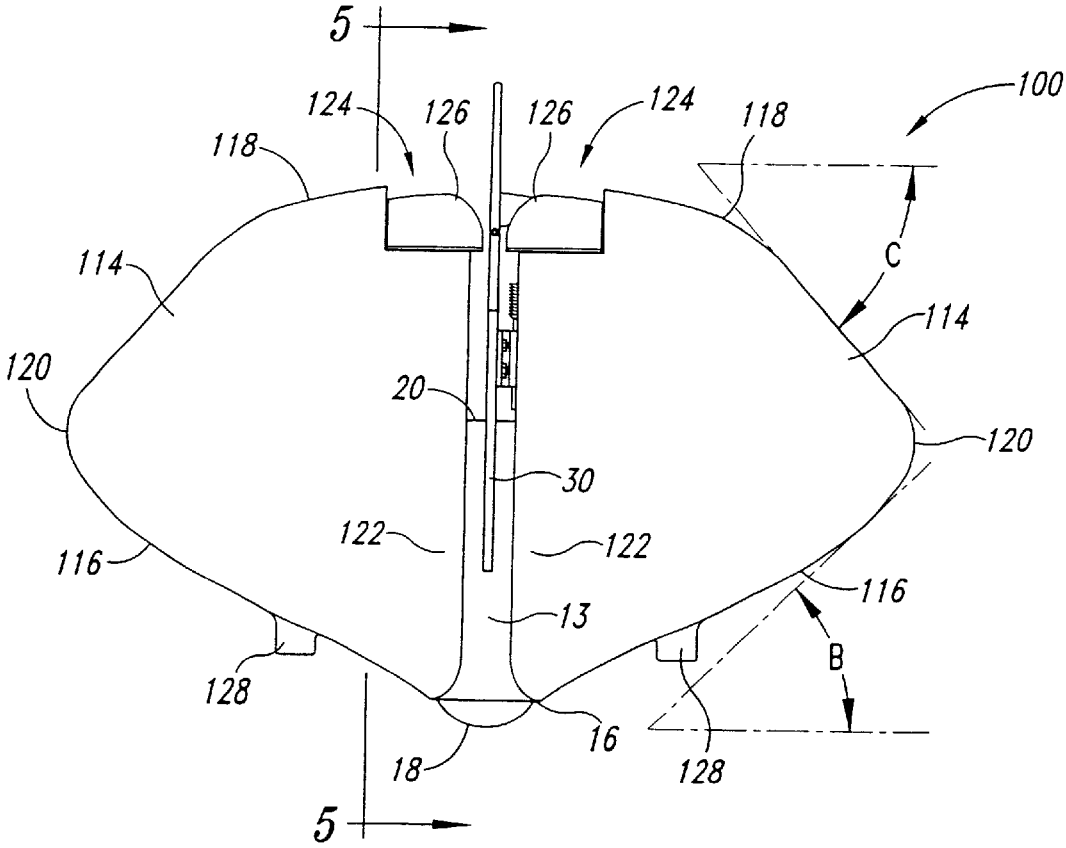
FIG. 3 is a top elevational view of the arcuate-winged submersible vehicle of FIG. 2.

FIG. 3 is a top elevational view (or "planform" view) of the arcuate-winged submersible vehicle 100 showing additional features of the arcuate wings 114. In this embodiment, each arcuate wing 114 has a leading edge 116 that is swept in a rearward direction. In other words, the leading edges 116 do not project from the body 13 in a perpendicular direction, but rather, are angled toward the rear of the vehicle at an angle B which varies with distance from the body 13. The light fixture 128 projects slightly ahead of the leading edge 116 of each arcuate wing 114.

As further shown in FIG. 3, each arcuate wing 114 also has a trailing edge 118 that is swept in a forward direction at an angle C which also varies with distance from the body 13. The leading and trailing edges 116, 118 of the arcuate wings 114 join together at a smoothly curved wing tip 120. Each arcuate wing 114 also has a wing root 122 attached to the body 13. The trailing edge 118 of each arcuate wing 114 is further shaped to define a cutout area 124, and a wing steering flap 126 is hingeably attached to each arcuate wing 114 and received within the cutout area 124. Each wing steering flap 126 is adjustably deflectable over a range of positions from a full-up position to a full-down position.

In the embodiment shown in FIG. 3, the angle B of the swept leading edge 116 averages about 32 degrees along an inner section near the body, decreases to an average of about 27 degrees along a middle section of the leading edge 116, increases again to an average of about 45 degrees along an outer section, and then continues to increase to 90 degrees at the wing tip 120 to smoothly join with the trailing edge 118. Similarly, the angle C of the swept trailing edge 118 varies from an average of about zero degrees along an inner section near the body, increases to an average of about 47 degrees along a middle section of the trailing edge 118, and then continues to increase to 90 degrees at the wing tip 120. It should be understood, however, that the variation of the angles B and C of the leading and trailing edges 116, 118 respectively, may be varied from the particular embodiment shown to any number of possible configurations depending upon the intended maneuverability characteristics or the desired appearance of the vehicle, including, for example, holding angles B and C constant.

Figure 4:
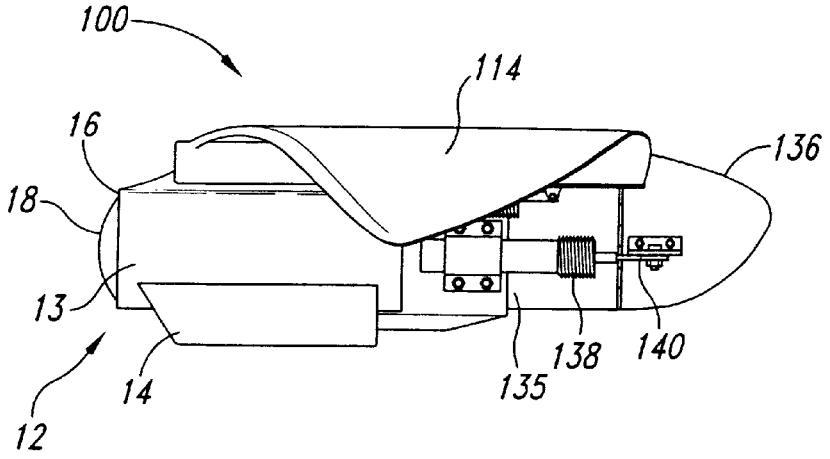
FIG. 4 is a side elevational view of the arcuate-winged submersible vehicle of FIG. 2.
Figure 5:
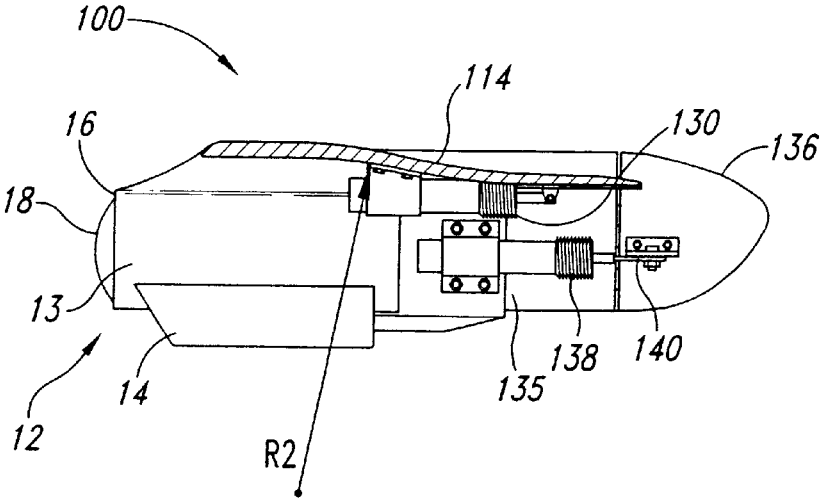
FIG. 5 is a partial cross-sectional view of the arcuate-winged submersible vehicle taken along line 5—5 of FIG. 3.

FIG. 4 is a side elevational view of the arcuate-winged submersible vehicle 100, and FIG. 5 is a partial cross-sectional view of the vehicle 100 taken along line 5—5 of FIG. 3. As shown in FIG. 5, the arcuate wings 114 has a cross-sectional shape 115 that has a longitudinal radius of curvature R2. In this embodiment, the longitudinal radius of curvature R2 is approximately infinite near the leading edge 116 and the trailing edge 118 of the cross-sectional shape 115 (i.e. the wing is substantially planar near the leading and trailing edges 116, 118). Along an intermediate portion, the cross-sectional shape 115 has a positive longitudinal radius of curvature R2, followed by a negative longitudinal radius of curvature R2 and the cross-sectional shape 115 becomes planar near the trailing edge 118.

Because the arcuate-winged vehicle 100 has an approximately planar portion (i.e. approximately infinite lateral and longitudinal radii of curvature R1, R2) in the vicinity of the cutout areas 124 of the trailing edges 118, the wing steering flaps 126 are substantially planar. This configuration preferably enables the wing steering flaps 126 to be hingeably attached to the arcuate wings 114 in a conventional straight-hinge fashion to reduce turbulence and cavitation for improved wing steering flap performance.

Alternately, the lateral radius of curvature R1 in the vicinity of the cutout areas 124 may be finite (i.e. curved), and the wing steering flaps 126 may be contoured to the shape of the arcuate wings 114 and joined to the wings in a less conventional manner. This may be accomplished, for example, by dividing each wing steering flap 126 into multiple segments (not shown) with each segment being individually hingeably attached to the arcuate wing 114.

Numerous other features of the arcuate wings 114 may be varied from their particular configuration shown in FIGS. 2 through 5. As mentioned above, the variation of the angles B and C of the leading and trailing edges 116, 118 respectively, may be varied from the particular embodiment shown. Alternately, the leading edges 116 may be forwardly swept, or the trailing edges 118 may be rearwardly swept, or the leading and trailing edges 116, 118 may project perpendicularly from the body 13. Furthermore, the lateral and longitudinal radii of curvature R1, R2 of the arcuate wings 114 may be varied from the curvatures shown in the accompanying figures, including, for example, holding these parameters constant.

Figure 6:
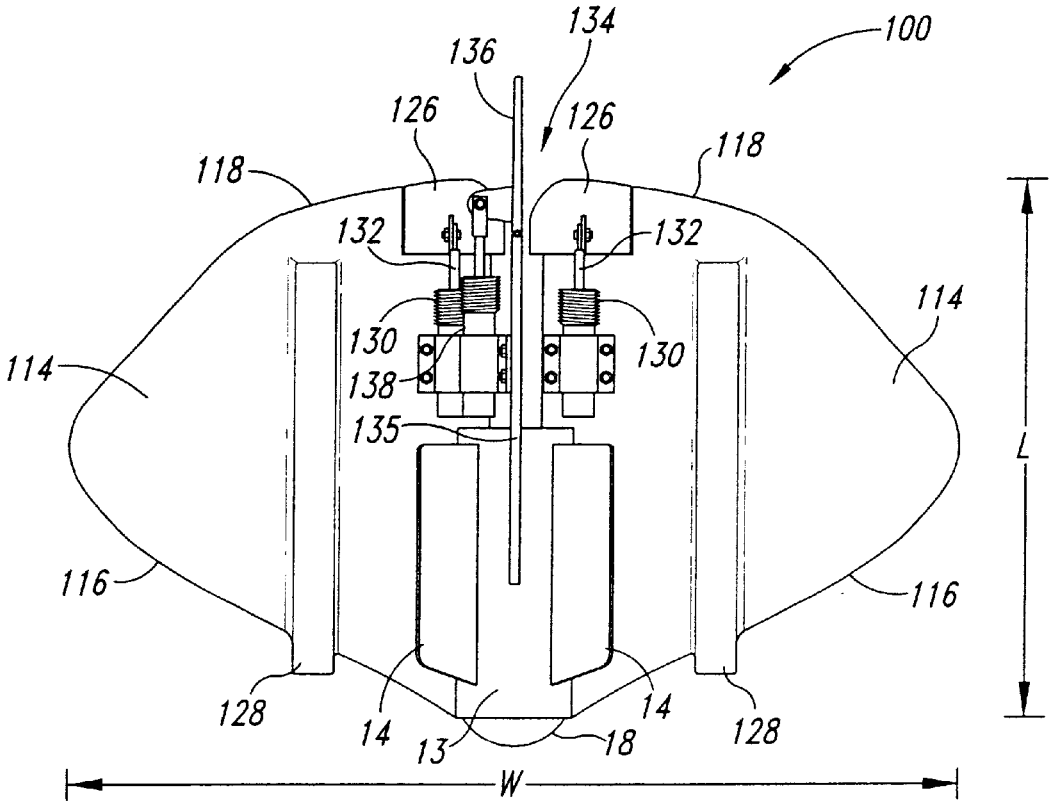
FIG. 6 is a bottom elevational view of the arcuate-winged submersible vehicle of FIG. 2.

FIG. 6 is a bottom elevational view of the arcuate-winged submersible vehicle 100 showing a wing flap actuator 130 attached to the lower surface of each arcuate wing 114. An actuator arm 132 extends from each actuator 130 to each wing steering flap 126 for actuating the wing steering flap 126 between the full-up and full -down positions, thereby providing depth control of the vehicle. The actuators 130 may be of any conventional type, including hydraulic or electrically-driven actuators, such as the Digit linear actuator available from Ultra Motion of Mattituck, N.Y.

The hull 12 also includes a tail assembly 134 having a rigid support 135 extending from the back 20 of the body 13. A vertical tail steering flap 136 is hingedly attached to the rigid support 135 and is hingeably and adjustably deflectable over a range of positions from a full-left position to a full-right position. As best seen in the side elevational view of the vehicle 100 shown in FIG. 4, a tail flap actuator 138 is attached to the rigid support 135. A control arm 140 attaches the tail flap actuator 138 to the tail steering flap 136 for actuating the tail steering flap 136 between the full-left and full-right positions, thereby providing lateral or yaw control of the vehicle.

One may note that a wide variety of control surface configurations may be utilized to control the vehicle 100. The wing steering flaps 126, for example, may be joined by an appropriate linkage to operate in unison so that only one wing flap actuator is needed to actuate both wing flaps to provide pitch control, although some controllability of the vehicle (e.g. roll control) may be sacrificed. Also, the wing flaps need not be disposed within cutout areas 124, and may be repositioned anywhere along the trailing edges of the wings. The wing flaps may even be eliminated and replaced by one or more control surfaces located elsewhere on the vehicle, including those which project from the tail assembly 134 (e.g. "elevators"), or from the body 13 (e.g. "canards"), or from other portions of the hull 12.

Similarly, the vertical tail steering flap 136 may be repositioned on the hull of the vehicle, or may be eliminated and replaced with suitable control surfaces that provide the desired lateral (or "yaw") directional control, including pairs of vertical control surfaces mounted on the wings or elsewhere on the vehicle. Furthermore, the vehicle may be controlled by replacing the wing flaps and the tail flap with a "V-tail" having two deflectable control surfaces that provide the desired pitch, yaw, and roll control. A non-exhaustive collection of possible control surface configurations suitable for use with arcuate-winged vehicles is presented by Professor K. D. Wood's "Aerospace Vehicle Design, Volume I," Second Edition, at pages 1–9:22 through 1–9:23, published by Johnson Publishing Company of Boulder, Colo., incorporated herein by reference.

Figure 1:
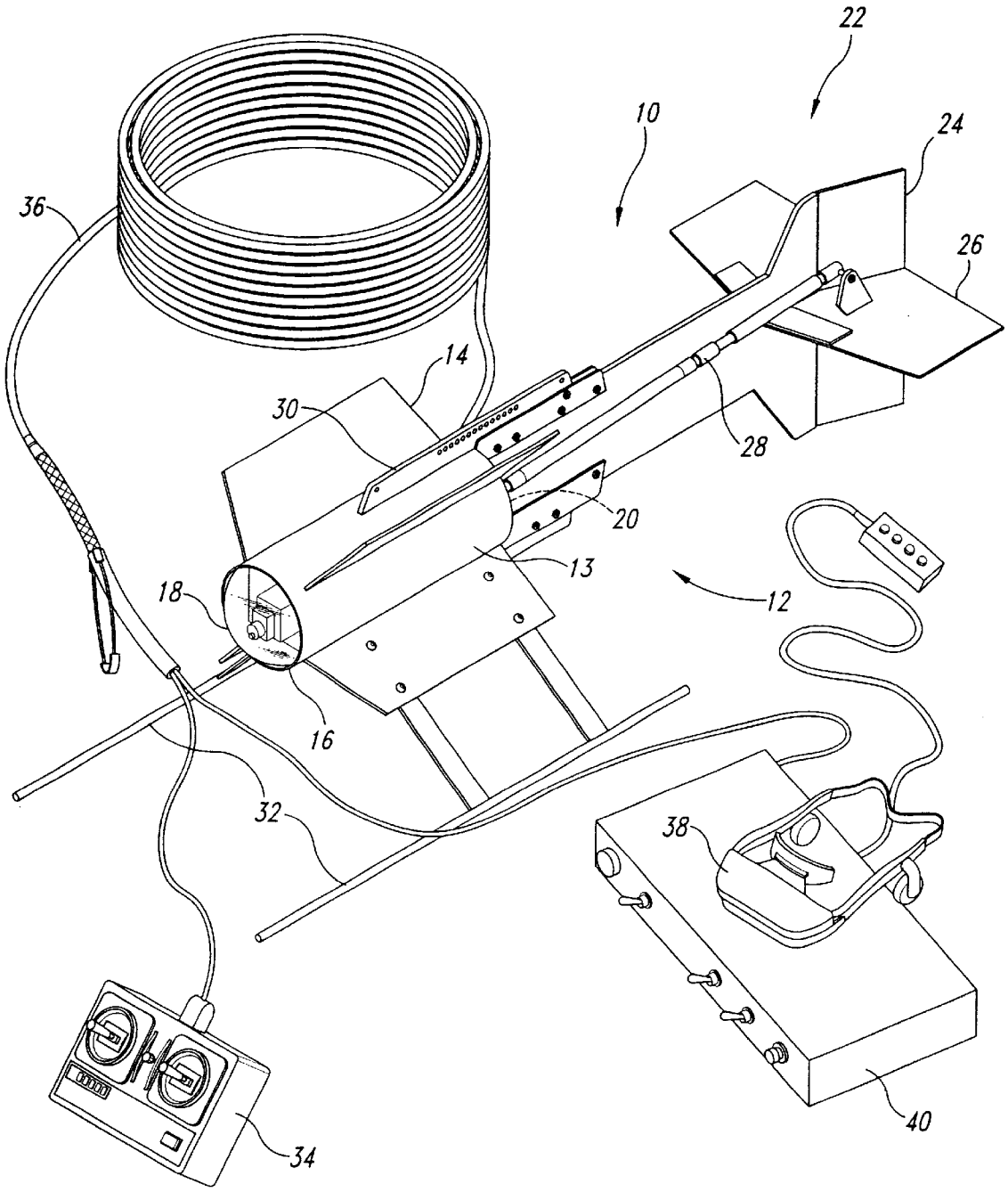
Fig. 1 (Prior Art)
FIG. 1 is an isometric view of a towed submersible vehicle and related support equipment in accordance with the prior art.
Figure 7:
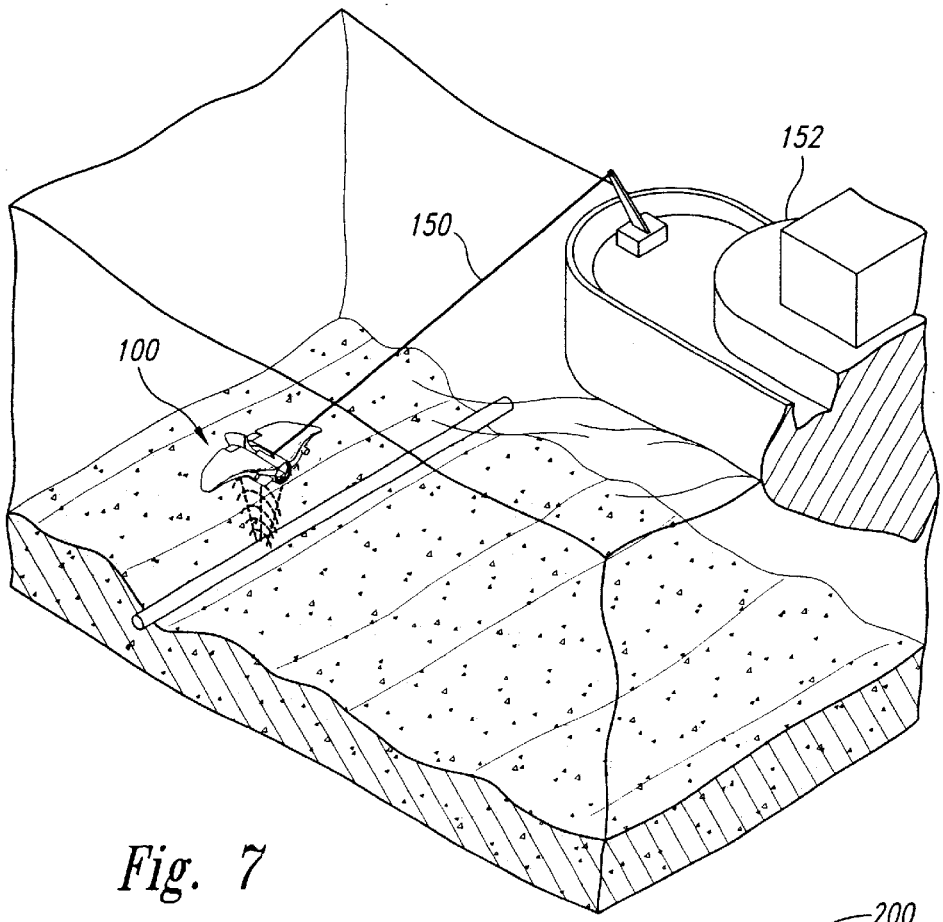
FIG. 7 is an isometric view of the arcuate-winged submersible vehicle of FIG. 2 being towed by a surface vessel.

FIG. 7 is an isometric view of the arcuate-winged submersible vehicle 100 being towed behind a surface vessel 152 using a tether 150. As the vehicle 100 is towed through a fluid medium, the arcuate wings 114 enhance the stability and controllability of the vehicle's movement through the medium. An operator or controller (not shown) on the surface vessel 152 may control the flight of the vehicle 100 by transmitting control signals from a control unit to the wing and tail flap actuators 130, 138. The control signals may be electrically transmitted from the control unit via an umbilical (FIG. 1), or by an RF signal sent by a transmitting antenna, or even by acoustic signals. The operator transmits appropriate control signals to the wing flap and tail flap actuators 130, 136 to deflect the wing steering flaps 126 and tail steering flap 136 thereby controlling the depth and lateral position of the vehicle with respect to the direction of travel of the surface vessel. In this manner, the operator pilots the arcuate-winged submersible vehicle 100 over a desired flight path.

The operator may receive visual images or other feedback signals from a camera or other navigational equipment (e.g. inclinometer, depth gauge, sonar, etc.) on board the vehicle to assist in operating the vehicle. In addition, a computer, microcomputer, or other programmable device may be located on-board the vehicle, such as within the payload compartment, to monitor input signals from the controller or from the navigational sensors and to transmit appropriate feedback signals to the controller on the surface vessel 152, or control signals to the actuators 130, 138 to control wing steering flap deflections and tail steering flap deflections, respectively. The on-board computer or control system might therefore be used, for example, as a safety system to prevent the vehicle from exceeding a maximum depth, to maintain the attitude of the vehicle, or to prevent collisions with submerged structures.

The arcuate-winged submersible vehicle 100 provides markedly improved stability and maneuverability over prior art submersible vehicles having straight wings or simple fins. The arcuate-shaped wings 114 increase the operator's control over the vehicle, improving the ability to fly the vehicle along a desired path over the floor of the ocean, especially when the vehicle is guided a great distance to the left or right of the surface vessel 152. Undesirable rolling characteristics exhibited by prior art vehicles are substantially reduced or eliminated. Similarly, the stability and maneuverability of the arcuate-winged vehicle in a strong cross-current is favorably improved over the characteristics of prior art submersible vehicles.

The improved hydrodynamic maneuverability and stability of the submersible arcuate-winged vehicle 100 provides superior payload delivery and data acquisition characteristics over prior art submersible vehicles. Because the vehicle is more stable, data acquired from a variety of payload devices (cameras, sonar, microphones, etc.) are of better quality than obtained using prior art submersible vehicles. Therefore, the arcuate-winged submersible vehicle 100 provides improved hydrographic survey data for such applications as marine bio-mass surveys in fisheries, ecological surveys, underwater mapping surveys or mineral exploration or searching for shipwrecks, and many other applications.

As described above, the shape of the arcuate-winged vehicle 100 may differ from that shown in the figures. Tests suggest, however, that the shape having the swept leading and trailing edges 114, 116 as shown in the accompanying figures provides desirable vehicle stability and maneuverability characteristics. In particular, for a wingspan w defined as the distance from wing tip to wing tip of the arcuate wings 114 (see FIG. 6), and a distance L is defined as the maximum distance from the leading edge to the trailing edge of the arcuate wings 114, optimum characteristics have been achieved where the ratio w/L is approximately equal to 3/2.

It should also be understood that the arcuate wings 114 may project from the hull 12 from any number of positions about the circumference of the body 13. For example, the arcuate wings may attach to the body 13 at higher or lower positions than those shown in FIG. 2. Desirable results have been achieved, however, with the configuration shown in FIG. 2 where the curvature of the arcuate wings 114 is such that the wing tips 120 are at approximately the same "water line" (i.e., same vertical level) as the attachment point between the wing root 122 and the body 13.

Figure 8:
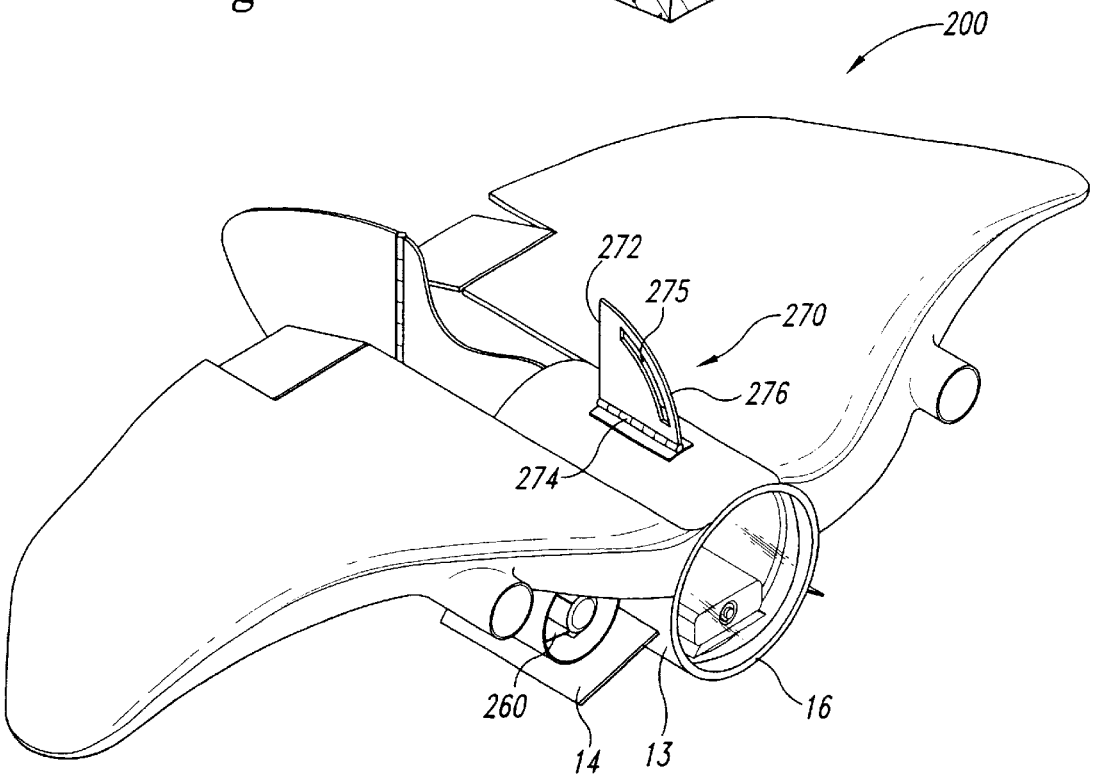
FIG. 8 is an isometric view of an alternate embodiment of an arcuate-winged submersible vehicle in accordance with the invention.

FIG. 8 shows an arcuate-winged submersible vehicle 200 in accordance with an alternate embodiment of the invention. In this embodiment, the arcuate-winged submersible vehicle 200 includes a propulsion unit 260 attached to each fin 14. The propulsion units 260 are of any conventional type, including electrical or hydraulic units, and advantageously enable the vehicle 200 to be propedlled along a desired path without being towed by a surface vessel. As the vehicle 200 propels itself through the fluid medium, the arcuate wings enhance the stability and controllability of the vehicle's movement through the medium. The desired stability and maneuverability characteristics are thereby achieved in an autonomously powered vehicle 200. Although the arcuate-winged vehicle 200 may remain tethered to a surface vessel for purposes of recovery or launch of the vehicle 200, or for transmittal of control signals to the control actuators or to the propulsion units 260, the vehicle 200 is otherwise free to maneuver independently from the surface vessel.

The arcuate-winged vehicle 200 further includes a hingable tow point assembly 270. The tow point assembly 270 has a tow plate 272 coupled to the body 13 of the hull 12 by a hinge 274. The tow plate 272 includes an arcuate slot 274 disposed therethrough and positioned proximate to an arcuate leading edge 276 of the tow plate 272. The arcuate slot 274 is sized to receive a shackle (not shown) of a tow cable or tether for launch or recovery of the vehicle. The tow point assembly 270 is especially useful however, on towed vehicle configurations such as the vehicle 100 shown in FIGS. 2 through 7.

In operation, the tow plate 272 of the hingable tow point assembly 270 is pivotably movable with respect to the body 13 about the hinge 274. The tow plate 272 adjustably pivots over a range of positions from a full left position contacting one arcuate wing 114 to a full right position contacting the other arcuate wing 114. Therefore, as an operator controls the tail steering flap deflection to guide the vehicle laterally to the side of the surface vessel, the tow plate 272 pivots about the hinge 274, and undesirable rolling of the vehicle 200 caused by the tow cable is reduced or eliminated. Similarly, as the operator adjusts the wing steering flap deflection to cause the vehicle to dive to greater depths, the shackle of the tow cable slides within the arcuate slot 274. In this way, undesirable nose up or nose down pitching of the vehicle caused by the tow cable is reduced or eliminated.

Several features of the tow point assembly 270 may be varied from the embodiment shown in FIG. 8. The size and shape of the tow plate 272, for example, may be modified to a wide variety of suitable sizes and shapes. Similarly, the length and shape of the arcuate slot 274 may be varied as desired, including quarter-circular, semi-circular, elliptic, and parabolic shapes. The most suitable geometry of the tow point assembly for a particular submersible vehicle may depend on a number of factors, including the anticipated flight path of the vehicle. Although the tow point assembly 270 is shown in FIG. 8 on an arcuate-winged vehicle 200, it is also suitable for use with a wide variety of towed or autonomously powered conventional submersible vehicles that do not have arcuate wings.

Although specific embodiments of, and examples for, the invention are described herein for illustrative purposes, various equivalent modifications are possible within the scope of the invention, as those skilled in the relevant art will recognize. The teachings provided herein of the invention can be applied to other arcuate winged submersible vehicles, not necessarily the exemplary arcuate winged submersible vehicles described above and shown in the figures. In general, in the following claims, the terms used should not be construed to limit the invention to the specific embodiments disclosed in the specification and the claims, but should be construed to include all submersible vehicles that operate within the broad scope of the claims. Accordingly, the invention is not limited by the foregoing disclosure, but instead its scope is to be determined by the following claims.

What is claimed is:

1. A submersible vehicle, comprising:

a hull having a longitudinal axis and a pair of outwardly projecting at least partially arcuate wings, at least a portion of each arcuate wing being curved about a radius of curvature that lies in a plane approximately normal to the logitudinal axis of the hull;

a wing steering flap hingeably attached to each wing, each wing steering flap being adjustably positionable to provide at least partial control of the movement of the vehicle;

at least one wing flap actuator coupled to the hull and to the wing steering flaps to controllably adjust the position of the steering flaps;

a tail steering flap hingeably attached to he hull, the tail steering flap being adjustably positionable to provide at least partial control of the movement of the vehicle; and at least one tail flap actuator coupled to the hull and to the tail steering flap to controllably adjust the position of the tail steering flap.

2. The vehicle of claim 1 wherein each arcuate wing has a swept leading edge.

3. The vehicle of claim 1 wherein each arcuate wing has a swept trailing edge.

4. The vehicle of claim 1 wherein each arcuate wing includes a trailing edge having a substantially planar section and a cutout area disposed therein, the wing steering flaps being attached to the arcuate wings and received within the cutout areas.

5. The vehicle of claim 1 wherein each arcuate wing has a wing root attached to the hull and a wing tip, and wherein the curvature of each arcuate wing is such that the wing tip is at approximately the same water line as the wing root.

6. The vehicle of claim 1, further comprising a tow point attached to the hull and coupleable with a tow cable.

7. The vehicle of claim 6 wherein the tow point includes an arcuate slot.

8. The vehicle of claim 1, further comprising at least one fin projecting from the hull to enhance stability of the vehicle during movement.

9. The vehicle of claim 1, further comprising a propulsion unit attached to the hull for propelling the vehicle through a fluid medium.

10. The vehicle of claim 1, further comprising a propulsion unit attached to the hull for propelling the vehicle through a fluid medium.

11. A submersible vehicle, comprising:

a hull having a longitudinal axis and a pair of outwardly projecting at least partially arcuate wings, at least a portion of each arcuate wing being curved about a radius of curvature that lies in a plane approximately normal to the lingitudinal axis of the hull;

a first control surface attached to the hull that is adjustably positionable to provide at least partial control of at least a first dynamic characteristic of the vehicle;

a first actuator coupled to the hull and to the first control surface to controllably adjust the position of the first control surface;

a second control surface attached to the hull that is adjustably positionable to provide at least partial control of at least a second dynamic characteristic of the vehicle; and a second actuator coupled to the hull and to the second control surface to controllably adjust the position of the second control surface.

12. The vehicle of claim 11 wherein the hull has a tow point coupleable to a tether from a surface vessel.

13. The vehicle of claim 11, further comprising a propulsion unit attached to the hull for propelling the vehicle through a fluid medium.

14. A submersible vehicle, comprising:

a hull having a lingitudinal axis and a pair of outwardly projecting at least partially arcuate wings at least a portion of each arcuate wing being curved about a radius of curvature that lies in a plane approximately normal to the longitudinal axis of the hull;

adjustable control surface means attached to the hull for adjustably controlling a dynamic characteristic of the vehicle; and a plurality of actuators coupled to the hull and to the adjustable control surface means to controllably adjust the adjustable control surface means.

15. The vehicle of claim 14 wherein the hull has a tow point coupleable to a tether from a surface vessel.

16. The vehicle of claim 14, further comprising a propulsion unit attached to the hull for propelling the vehicle through a fluid medium.

17. A submersible vehicle, comprising:

a hull having a longitudinal axis;

a pair of at least partially arcuate wings projecting outwardly from the hull, at least a portion of each arcuate wing being curved about a radius of curvature that lies in a plane approximately normal to the longitudinal axis of the hull;

at least one wing steering flap moveably attached to at least one arcuate wing;

at least one wing flap actuator coupled to the at least one wing steering flap to controllably adjust the position of the at least one wing steering flap;

a tail steering flap moveably attached to the hull; and at least one tail flap actuator coupled to the tail steering flap to controllably adjust the position of the tail steering flap.

18. The submersible vehicle of claim 17 wherein the radius of curvature increases along the arcuate wing with increasing distance from the hull.

19. The submersible vehicle of claim 17 wherein the radius of curvature remains constant along the arcuate wing with increasing distance from the hull.

20. The submersible vehicle of claim 17 wherein each at least partially arcuate wing is curved downwardly about a radius of curvature.

21. The submersible vehicle of claim 17 wherein each arcuate wing includes a first porion that projects outwardly from the hull at an angle A from vertical, where the angle A is within the range of about 30 degrees to about 70 degrees.

22. The submersible vehicle of claim 17 wherein each arcuate wing has a rearwardly swept leading edge and a forwardly swept trailing edge that joins with leading edge at a wing tip.

23. The submersible vehicle of claim 17 wherein each arcuate wing has a rearwardly swept leading edge and a forwardly swept trailing edge that joins with leading edge at a wing tip, and wherein a ration of a wingspan over a maximum distance from the leading edge to the trailing edge is approximately 3/2.

24. The submersible vehicle of claim 17 wherein each arcuate wing has a wing root attached to the hull and a wing tip, and wherein the curvature of each arcuate wing is such that the wing tip is at approximately the same water line as the wing root.

25. The submersible vehicle of claim 17, further comprising a propulsion unit attached to the hull for propelling the vehicle through a fluid medium.

* * * * *